US007927389B2

(12) United States Patent
Sakakibara et al.

(10) Patent No.: US 7,927,389 B2
(45) Date of Patent: Apr. 19, 2011

(54) SUPERABRASIVE GRAIN SETTING METHOD

(75) Inventors: Sadao Sakakibara, Hekinan (JP); Kodo Kobayashi, Okazaki (JP); Hiroyasu Shimizu, Okazaki (JP); Kazuhiko Sugita, Anjo (JP)

(73) Assignee: Toyoda Van Moppes Ltd., Okazaki-shi (JP)

( * ) Notice: Subject to any disclaimer, the term of this patent is extended or adjusted under 35 U.S.C. 154(b) by 207 days.

(21) Appl. No.: 12/272,125

(22) Filed: Nov. 17, 2008

(65) Prior Publication Data

US 2009/0139148 A1 Jun. 4, 2009

(30) Foreign Application Priority Data

Dec. 3, 2007 (JP) ..... 2007-312891

(51) Int. Cl.

| | |
|---|---|
| ***B24D 3/00*** | (2006.01) |
| ***B24D 11/00*** | (2006.01) |
| ***B24D 18/00*** | (2006.01) |
| ***C09K 3/14*** | (2006.01) |

(52) U.S. Cl. ..... 51/293

(58) Field of Classification Search ..... 51/293
See application file for complete search history.

(56) References Cited

U.S. PATENT DOCUMENTS

| | | | | |
|---|---|---|---|---|
| 3,877,891 | A | 4/1975 | Inoue | |
| 7,507,267 | B2 * | 3/2009 | Hall et al. | 51/293 |
| 2003/0186636 | A1 | 10/2003 | Akyuz et al. | |
| 2006/0010780 | A1 * | 1/2006 | Hall et al. | 51/293 |
| 2009/0017276 | A1 * | 1/2009 | Hoglund et al. | 428/206 |
| 2009/0202781 | A1 * | 8/2009 | Hall et al. | 428/143 |

FOREIGN PATENT DOCUMENTS

| | | |
|---|---|---|
| BE | 1 012 247 A4 | 8/2000 |
| JP | 56-163879 | 12/1981 |

OTHER PUBLICATIONS

U.S. Appl. No. 12/269,297, filed Nov. 12, 2008, Sadao Sakakibara, et al.

* cited by examiner

*Primary Examiner* — Jerry Lorengo
*Assistant Examiner* — Ross J Christie
(74) *Attorney, Agent, or Firm* — Oblon, Spivak, McClelland, Maier & Neustadt, L.L.P.

(57) ABSTRACT

In a superabrasive grain setting method, a two-dimensionally developed coordinate preparation step is taken, wherein a non-cylindrical area of a mounting surface where a tangential line to the mounting surface in a plane including the axis of the manufacturing mold crosses with the axis of a manufacturing mold is developed into a circular-arc belt-like surface, and a plurality of mounting points are set on the circular-arc belt-like surface in a grid pattern in dependence on mounting positions for superabrasive grains. Then, a rectification step is taken, wherein the grid pattern of the mounting points is rectified in predetermined angular ranges so that the mounting points do not make consecutive point lines in the circumferential direction of the circular-arc belt-like surface. A mounting step is thereafter taken of mounting the superabrasive grains on the mounting surface of the manufacturing mold based on the grid pattern rectified at the rectification step.

9 Claims, 10 Drawing Sheets

SUPERABRASIVE GRAIN SETTING METHOD

INCORPORATION BY REFERENCE

This application is based on and claims priority under 35 U.S.C. 119 with respect to Japanese patent application No. 2007-312891 filed on Dec. 3, 2007, the entire content of which is incorporated herein by reference.

BACKGROUND OF THE INVENTION

1. Field of the Invention

The present invention relates to a superabrasive setting method for mounting superabrasive grains on a manufacturing mold in order to arrange superabrasive grains on a grinding surface of a rotary grinding tool such as grinding wheel, truing tool, dressing tool or the like in manufacturing the rotary grinding tool.

2. Discussion of the Related Art

In the manufacturing of a rotary grinding tool such as grinding wheel, truing tool, dressing tool or the like, it is often the case that a grinding surface of the grinding tool are formed by the use of superabrasive grains such as diamond, CBN (Cubic Boron Nitride) or the like. In this case, the grinding tool should have superabrasive grains arranged uniformly so that the grinding surface is able to grind a workpiece without any local imbalance in grinding operation. To this end, in manufacturing grinding tools, there is utilized a so-called "grain transfer method", wherein superabrasive grains arranged on an internal surface of a female-type manufacturing mold are transferred onto an external grinding surface of a male-type grinding tool, while superabrasive grains arranged on an external surface of a male-type manufacturing mold are transferred onto an internal grinding surface of a female-type grinding tool.

For example, in Japanese unexamined, published patent application No. 56-163879, an adhesive is applied to an internal surface of a female-type mold as a manufacturing mold for a grinding tool, a net having a mesh size which is somewhat larger than the grain size of diamond abrasive grains is set on the internal surface of the female-type mold, and the diamond abrasive grains are distributed over the net so that diamond abrasive grains are distributed and secured in a grid pattern at space intervals wherein a suitable clearance is secured between each abrasive grain and the next thereto. Therefore, only the diamond abrasive grains which dropped into the mesh holes of the net can be adhered and retained with the adhesive, while other diamond abrasive grains remaining on the net are not adhered. As a consequence, diamond abrasive grains can be arranged regularly at a predetermined distribution density with one diamond abrasive grain set in one mesh hole.

Arranging diamond abrasive grains in a grid pattern as described in the Japanese patent application is very effective in distributing diamond abrasive grains simply and uniformly.

However, it is often the case that the mounting surfaces of the manufacturing mold include a taper surface, a rounded surface, an end surface and the like. Therefore, if it is tried to make arrangement on any of these surfaces in a grid pattern, diamond abrasive grains align consecutively in the circumferential direction at four areas of 90-degree intervals due to the fact that one or the other side of the grid pattern becomes parallel to the circumferential direction of the manufacturing mold and at another four areas of 90-degree intervals spaced through an angle of 45 degrees from the first-mentioned four areas due to the fact that either one of diagonal lines of the grid pattern becomes parallel to the circumferential direction. In a grinding tool which is made by the use of such a manufacturing mold, a problems arise in that grinding accuracy is deteriorated because there occur either one of phenomena that abrasive grains behind in the rotational direction of those making consecutive grain lines do not contribute to grinding work, that some of the abrasive grains are delayed in abrasion from others and that much metal removal takes place at each of portions on a workpiece which are brought into contact with those portions making consecutive grain lines of a grinding tool.

SUMMARY OF THE INVENTION

It is therefore a primary object of the present invention to provide an improved superabrasive grain setting method which is capable of being adapted to a complicated surface shape of a manufacturing mold and is also capable of setting superabrasive grains on the manufacturing mold so that a grinding tool manufactured by the use of the manufacturing mold can secure uniformity in grinding operations.

Briefly, according to the present invention, there is provided a superabrasive grain setting method for arranging, in a grid pattern, superabrasive grains on a mounting surface of a rotary shape manufacturing mold which is used in manufacturing a rotary grinding tool. The method comprises a two-dimensionally developed coordinate preparation step of developing a non-cylindrical area of the mounting surface where a tangential line to the mounting surface in a plane including the axis of the manufacturing mold crosses with the axis of the manufacturing mold, into a circular-arc belt-like surface in the form of a plane and setting a plurality of mounting points on the circular-arc belt-like surface in the grid pattern in dependence on mounting positions for the superabrasive grains; a rectification step of rectifying the grid pattern of the mounting points in predetermined angular ranges which respectively have centers thereof at different positions in the circumferential direction of the circular-arc belt-like surface so that in each of the predetermined angular ranges, the plurality of mounting points do not make consecutive point lines in the circumferential direction of the circular-arc belt-like surface; and a mounting step for mounting the superabrasive grains on the mounting surface of the manufacturing mold based on the arrangement of the mounting points which are designated by the grid pattern rectified at the rectification step.

In the superabrasive grain setting method, the non-cylindrical area of the manufacturing mole CW on which diamond abrasive grains D are to be arranged in the grid pattern is developed into the circular-arc belt-like surface in the form of a plane, and the plurality of mounting points are rectified not to consecutively align in the circumferential direction of the circular-arc. By taking these simplified steps, it becomes possible to obviate such phenomena that each diamond abrasive grain behind those aligned consecutively does not contribute to a grinding operation, that some of the abrasive grains are delayed in abrasion from others and that much metal removal takes place at each of portions on a workpiece which are brought into contact with those portions making consecutive grain lines of a grinding tool. Therefore, it becomes possible to manufacture the manufacturing mold CW speedy and reliably for subsequent use in manufacturing a grinding tool capable of performing precise grinding operations.

BRIEF DESCRIPTION OF THE DRAWINGS

The foregoing and other objects and many of the attendant advantages of the present invention may readily be appreciated as the same becomes better understood by reference to the preferred embodiment of the present invention when considered in connection with the accompanying drawings, wherein like reference numerals designate the same or corresponding parts throughout several views, and in which.

DETAILED DESCRIPTION OF THE PREFERRED EMBODIMENT

Figure 1:
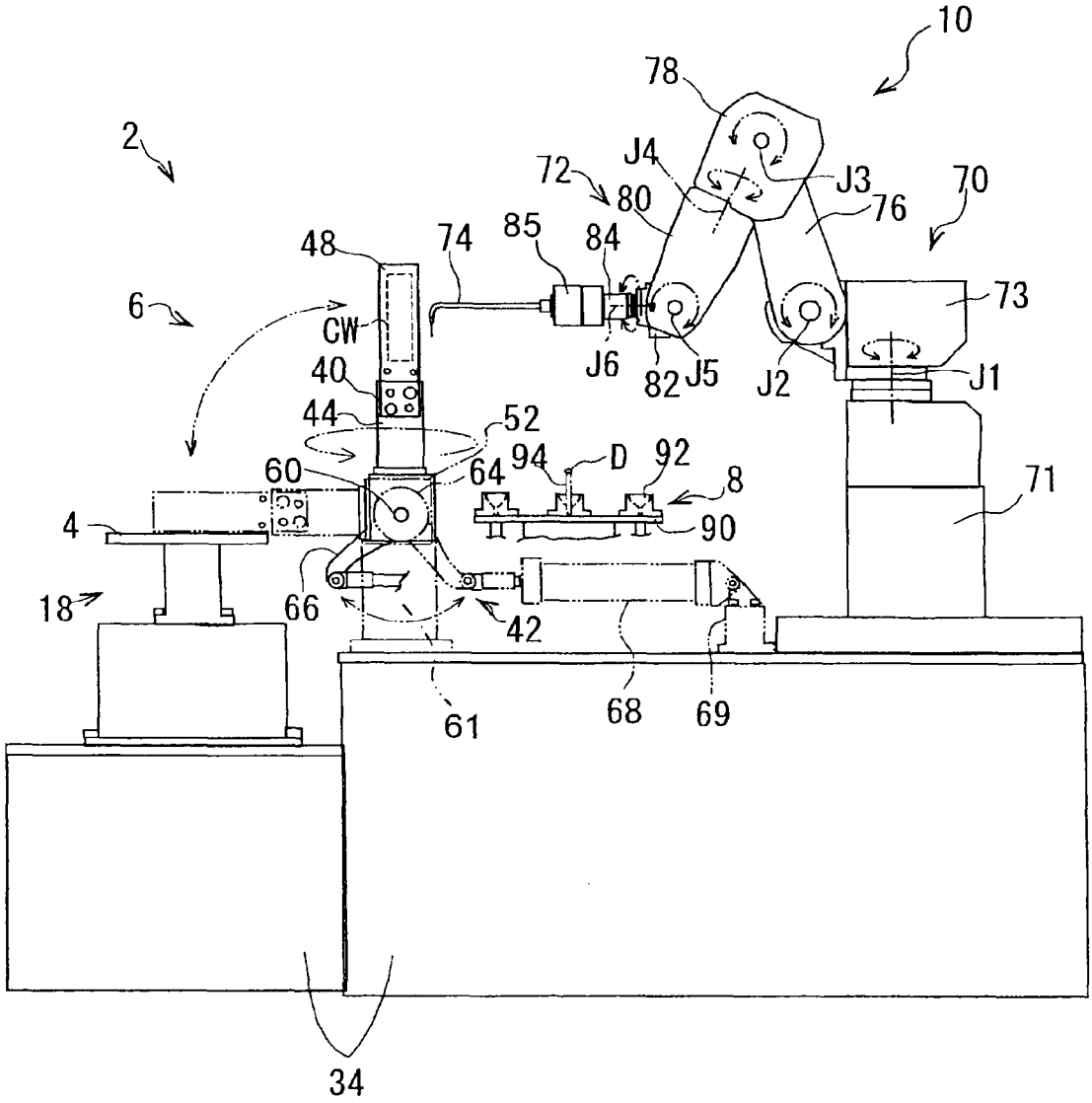
FIG. 1 is a general side view of an abrasive grain setting apparatus for practicing a superabrasive grain setting method in one embodiment according to the present invention.
Figure 2:
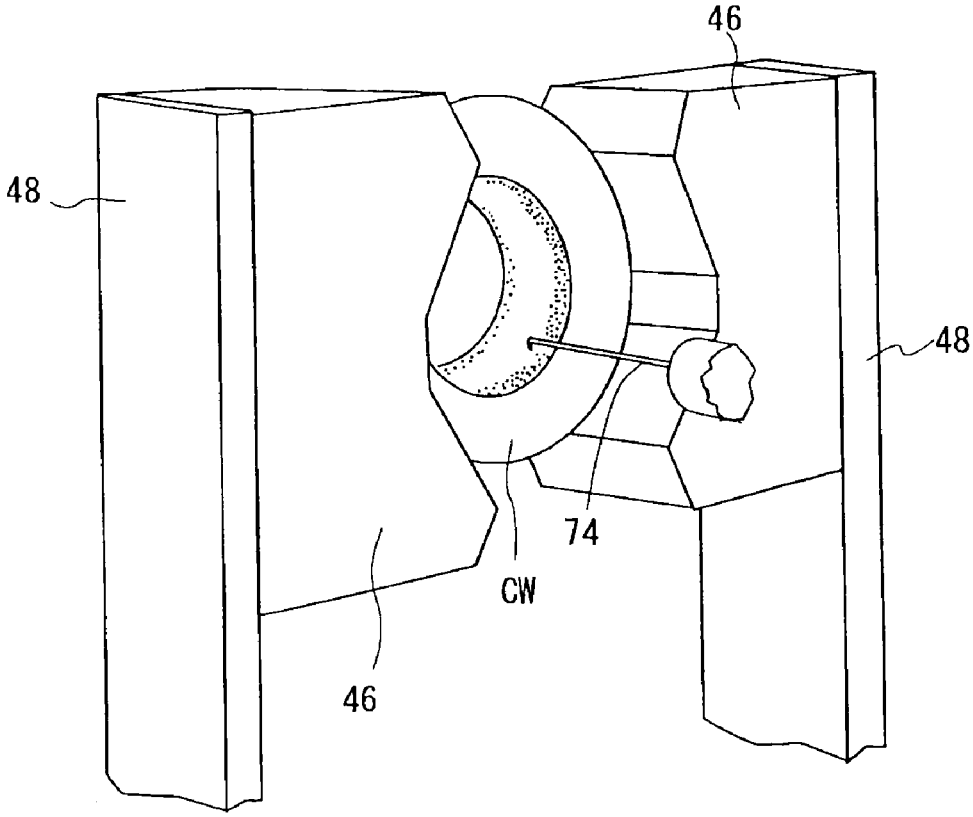
FIG. 2 is an enlarged fragmentary perspective view of the apparatus showing the manner of setting superabrasive grains on an internal surface of a manufacturing mold.

Hereafter, with reference to the accompanying drawings, description will be made regarding a superabrasive grain setting apparatus and a superabrasive setting method practiced by the apparatus in one embodiment according to the present invention. FIG. 1 is a schematic side view of the setting apparatus, and FIG. 2 is an enlarged perspective view showing the manner of setting superabrasive grains on a manufacturing mold in the setting apparatus. The manufacturing mold CW for use in manufacturing a grinding tool such as grinding wheel, truing tool, dressing tool or the like is made of, for example, carbon and takes a generally cylindrical form with flat end surfaces at opposite ends thereof. The setting of superabrasive grains is preformed on an internal surface of the manufacturing mold CW. This means that the manufacturing mold CW used here is a female-type mold for manufacturing a male-type grinding tool in a so-called "grain transfer method" wherein superabrasive grains arranged on the internal surface of the female-type mold are to be transferred to an external grinding surface of the male-type grinding tool.

The abrasive grain setting apparatus indicated by reference numeral 2 is composed of a loading table device 4 for loading the manufacturing mold CW from a loading position to a predetermined grip position and a grip and raising device 6 as a grip and raising mechanism for gripping and raising the loaded manufacturing mold CW held in a horizontal state to a raised or upright state that makes the axis of the manufacturing mold CW extend horizontally, through an angle of 90 degrees. The setting apparatus 2 is further composed of a superabrasive grain supply device 8 for storing diamond abrasive grains D as superabrasive grains which have been assorted in kinds and for supplying the diamond abrasives D one by one (i.e., grain by grain) to a suction position, and a six-axis control robot 10 for drawing a grain D of superabrasive supplied to the suction position to a suction nozzle 74 attached as end effecter to an endmost arm thereof and for mounting the grain D of superabrasive on the manufacturing mold CW gripped by the grip and raising device 6.

The loading table device 4 is provided with two loading and fixing units (not shown) thereon each for temporally holding the manufacturing mold CW thereon in the horizontal state and a swivel mechanism 18 for alternately positioning the two loading and fixing units to the loading position and the grip position by turning the two loading and fixing units through an angle of 180 degrees in a horizontal plane. Thus, the manufacturing mold CW held by each of the loading and fixing units is horizontally moved between the loading position and the grip position.

The grip and raising device 6 is composed of a grip mechanism 40 for gripping the manufacturing mold CW at the grip position, a raising mechanism 42 for raising the grip mechanism 40 from a horizontal position to a raised or upright position, and a horizontal turning mechanism 44 for turning the grip mechanism 40 held at the upright position about a vertical axis.

The grip mechanism 40 is provided with a pair of chuck members 46 (refer to FIG. 2) for gripping diametrically opposite portions on the circumferential surface of the manufacturing mold CW, and the respective chuck members 46 are secured respectively to a pair of support leg members 48 to be supported thereby. The pair of support leg members 48 are guided at their root portions to be movable toward and away from each other. A chucking air cylinder (not shown) is further provided, by which the pair of chuck members 46 are selectively closed or opened. The chucking air cylinder is in communication with to an air pump (not shown), and the air supply from the air pump to the chucking air cylinder is controlled by an electromagnetic valve (not show) provided therebetween, which is controllable by a system controller (not shown).

A support frame (not shown) slidably guides the pair of support leg members 48 on one end surface thereof and has the chucking air cylinder secured thereto for moving the pair of support leg members 48 (i.e., the chuck member 46) toward and away from each other. The support frame extends a horizontally rotary shaft (no shown) from the other end surface, and the horizontally rotary shaft is supported by a rotary base frame 52 to be rotatable about a vertical axis when the grip mechanism 40 is held at the upright position. The horizontally rotary shaft is rotatable by a turning air cylinder (not shown) mounted on the rotary base frame 52. The horizontally rotary shaft, the turning air cylinder and the like constitute the horizontal turning mechanism 44. The turning air cylinder is in communication with the air pump (not shown). The air supply from the air pump to the turning air cylinder is controlled by another or second electromagnetic valve (not shown) which is provided on another air communication line therebetween, and the second electromagnetic valve is controllable by the system controller.

The rotary base frame 52 is secured to one end of a raising rotary shaft 60, which is supported to be rotatable in a raising mechanism base 61 fixed on an apparatus base 34 and is rotatable about a horizontal axis orthogonal to the horizontally rotary shaft. The raising rotary shaft 60 has secured to the other end thereof a rotary disc 64 protruding a swing arm 66 from its circumferential surface. The extreme end of the swing arm 66 is linked to a piston of a raising air cylinder 68 whose base end portion is pivotably supported by a bracket 69 fixed on the apparatus base 34, and is pivotable in a vertical direction. The raising air cylinder 68 is in communication with the air pump (not shown), and another or third electromagnetic valve (not shown) is provided between the air pump and the raising air cylinder 68. The air supply from the air pump to the raising air cylinder 68 is controlled by the open/close operation of the third electromagnetic valve which is controllable by the system controller. With the operation of the raising air cylinder 68, the swing arm 66 is swung, so that the raising rotary shaft 60 is rotated in a range of 90 degrees to swing the grip mechanism 40 between the horizontal state and the upright or raised state. Thus, the superabrasive grain setting apparatus 2 is configured to perform the transfer of the manufacturing mold CW in the horizontal state that the manufacturing mold CW is held stably (i.e., with the axis of the manufacturing mold CW extending vertically), and to perform the setting work in the raised state that makes the setting work easier to do from one side of the manufacturing mold CW.

As shown in FIG. 1, the six-axis control robot 10 is fixedly installed on the apparatus base 34 in front of the grip and raising device 6. The robot 10 takes the construction that a wrist unit 72 with three controlled axes is attached to a second arm 78 of a base arm mechanism 70 with three controlled axes and that the suction nozzle 74 is detachably attached to an endmost axis or arm of the wrist unit 72.

The base arm mechanism 70 is constructed as follows. That is, a swivel base 73 is mounted on a robot base 71 fixed on the apparatus base 34 and is turnable about a first axis J1 normal to a horizontal plane. Space-saving is sought by jointing the swivel base 73 with the robot base 71, fixed on the apparatus base 34, through the first axis J1 in this way. A first arm 76 is jointed with the swivel base 73 to be swingable vertically about a horizontal second axis J2. The aforementioned second arm 78 is jointed to an extreme end of the first arm 76 to be vertically swingable about a third axis J3 parallel to the second axis J2.

The wrist unit 72 is constructed as follows. That is, a third arm 80 is jointed with an extreme end of the second arm 78 of the base arm mechanism 70 to be turnable about a fourth axis J4 perpendicular to (i.e., crossing) the third axis J3. A fourth arm 82 is jointed with an extreme end of the third arm 80 to be pivotable about a fifth arm J5 perpendicular to (i.e., crossing) the fourth axis J4. A fifth arm 84 as the endmost arm is jointed with an end portion of the fourth arm 82 to be rotatable about a sixth axis J6 perpendicular to (i.e., crossing) the fifth axis J5. The suction nozzle 74 as an end effecter is removably attached to an end portion of the fifth arm 84. The suction nozzle 74 is in communication with a vacuum pump (not shown) and draws a grain D of diamond abrasive to its nozzle end when having a negative pressure applied thereto. Three kinds of suction nozzles 74 whose nozzle end or nose portions are bent through angles of 90, 45 and 30 degrees are stored in a tool or nozzle magazine (not shown). For suction nozzle exchange, the six-axis control robot 10 is controlled to access the nozzle magazine so that any used suction nozzle on the wrist unit 72 is returned to a vacant one of nozzle holders (not shown) in the nozzle magazine and then, another suction nozzle is selectively attached to the wrist unit 72. Thus, each suction nozzle 74 on the wrist unit 72, together with the vacuum pump and still another or fourth electromagnetic valve (both not shown), constitute suction means for drawing a grain D of diamond superabrasive to the extreme end portion thereof.

Although not shown, six actuators such as servomotors are provided for respectively driving the first to sixth control axes J1-J6 and are controllable by the system controller constituted by a microcomputer and the like.

A weak current is applied to a chuck portion 85 which is provided at an extreme end of the fifth or endmost arm 84 for selectively attaching the suction nozzles 74. Thus, when the extreme end of a right-angle suction nozzle 74 attached to the wrist unit 72 is successively brought into plural places on a front end surface of the manufacturing mold CW which is held upright by the grip and raising device 6, the system controller serves as reference surface calculation means for calculating coordinates of the respective contact points on the end surface of the manufacturing mold CW to obtain a reference surface for a setting work. Further, when each of the contact points are moved inward in the radial direction of the manufacturing mold CW, a contact end point in such a radial inward movement, that is, a position on a circle defining the opening of the internal surface of the manufacturing mold CW can be located, and by repeating this step for the plural places on the front end surface of the manufacturing mold CW, the system controller serves as hole center calculation means for calculating the coordinates of the center of the hole formed in the manufacturing mold CW. The information on the reference surface and the center of the hole is stored in a memory device of the system controller and is used to calibrate the coordinates of the six-axis control robot 70. Thus, the diamond abrasive grains D can be set precisely on programmed target positions on the internal surface of the manufacturing mold CW based on the shape of the manufacturing mold CW which has been inputted in a control program. In this way, each of the suction nozzles 74 is used also as a touch sensing probe electrically connected to a touch sensor (not shown) incorporated in the system controller, and therefore, is made of an elastic metal (i.e., electrically conductive) material.

Referring again to FIG. 1, the superabrasive grain supply device 8 is arranged at a position on one side which position is almost equidistant from both of the six-axis control robot 10 and the grip mechanism 40 held in the upright position. The supply device 8 includes a horizontal disc-like magazine or tray 90, on which a plurality (six in this particular embodiment) of funnel-shaped storage buckets or cases 92 as storages are arranged at equiangular intervals. The disc-like tray 90 is rotatable by an indexing drive motor (not shown) about a vertical rotary shaft (not shown) to selectively index the storage cases 92 to a supply position. A lift-up rod 94 is provided in each of the storage cases 92 and is movable to vertically protrude from the bottom of a funnel portion of the storage case 92. When each of the storage cases 92 is selectively indexed to the supply position, the lift-up rod 94 of each such storage case 92 indexed to the supply position comes into alignment with a piston rod of a lift-up air cylinder (both not shown) which is arranged under the supply position, so that one grain D is lifted up and separated from other numerous diamond abrasive grains D contained in the storage case 92. Although not shown, each lift-up rod 94 is spring-biased to be usually retracted to a down position and has a small concavity on the top end for holding a single grain D of superabrasive thereon. Thus, a separation mechanism is constituted by the lift-up rods 94 and the lift-up air cylinder. A photoelectric detector (not shown) which is composed of a photo emitter and a photo sensor is arranged across the lift-up rod 94 moved upward at the supply position, so that the photoelectric detector can detect the presence/absence and the quality (i.e., the propriety for use) of the single grain D of diamond abrasive which is held at the suction position on the top of the lift-up rod 94.

Figure 3:
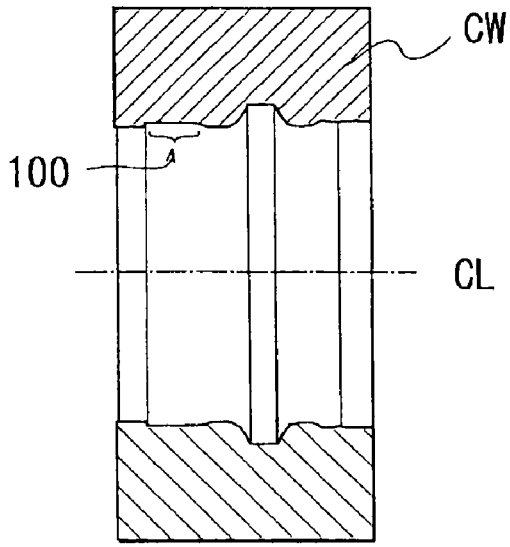
FIG. 3 is a longitudinal sectional view of a manufacturing mold in one example showing a cylindrical mounting surface.
Figure 4:
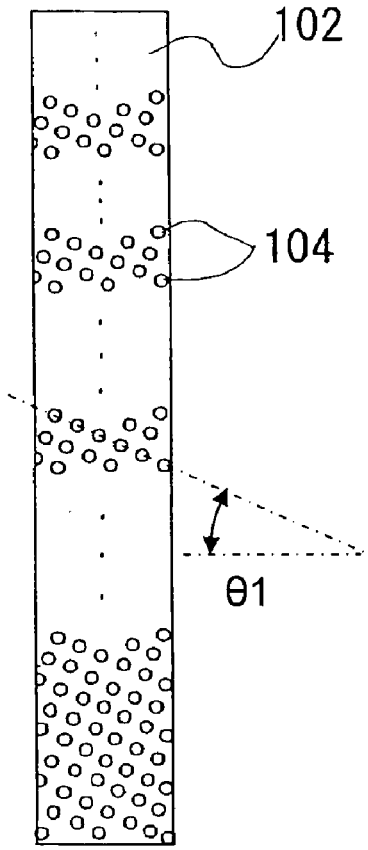
FIG. 4 is a development showing the cylindrical mounting surface of the manufacturing mold shown in FIG. 3.
Figure 9:
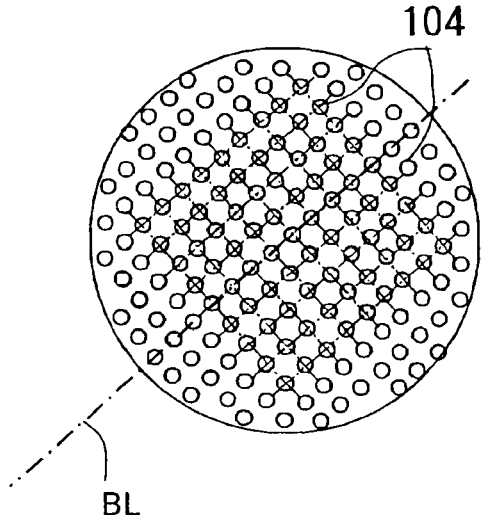
FIG. 9 is an enlarged fragmentary view of mounting points arranged in a grid pattern in the neighborhood of a prime reference line BL shown in FIG. 8.

In performing the setting by the use of the setting apparatus 2 as constructed above, the arrangement of diamond abrasive grains D is designated as coordinates in a mounting program which is used to control the six-axis control robot 10 during the setting operation. The arrangement of diamond abrasive grains D is determined in dependence on the shape of a mounting surface of the manufacturing mold CW to which surface the diamond abrasive grains D are to be mounted.

Where the setting should be performed at a cylindrical surface 100 on an internal surface of a manufacturing mold CW shown in FIG. 3, first of all, the cylindrical surface 100 to which the diamond abrasive grains D are to be mounted is developed into a flat surface taking a form of a two-dimensional rectangular belt-like surface 102, as shown in FIG. 4. Then, a plurality of mounting points 104 are arranged in a lattice or grid pattern (refer to FIG. 9) whose one side is inclined through an angle θ1, which is 30 degrees for example. This inclination is provided for the purpose of preventing the diamond abrasive grains D from making consecutive point lines in parallel with the axis CL of the manufacturing mold CW and hence, the axis of a grinding tool manufactured by the use of the manufacturing mold CW. Based on the arrangement of the mounting points 104, the system controller or another offline computer makes calculations to reconstruct the rectangular belt-like surface 102 which has been developed into a flat surface, into a three-dimensional cylindrical shape, so that the arrangement of the mounting points 104 is defined as coordinates in the three-dimensional cylindrical shape for use in setting the diamond abrasive grains D. The grid pattern in this particular embodiment is a square point-to-point interval grid pattern wherein both (one and the other) sides of the grid pattern have the same point-to-point intervals.

Figure 5:
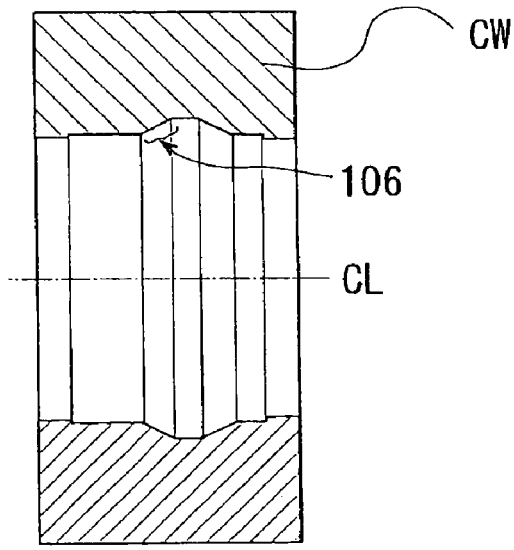
FIG. 5 is a longitudinal sectional view of a manufacturing mold in another example showing a taper mounting surface.
Figure 8:
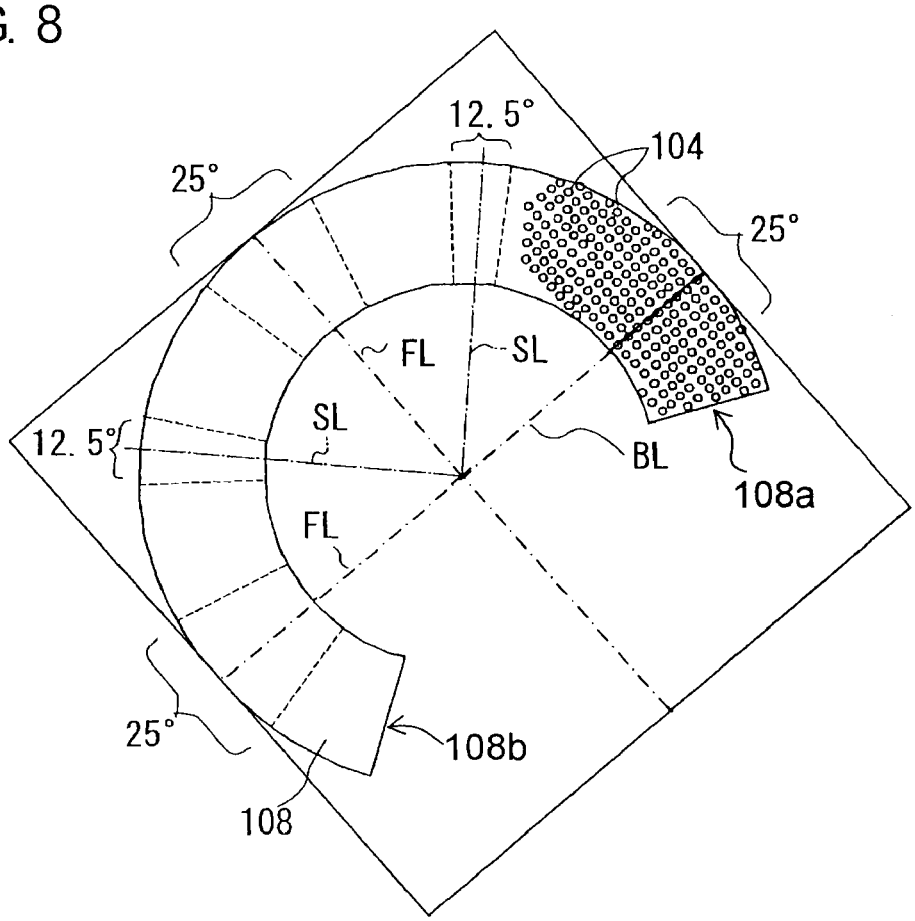
FIG. 8 is a plan view of a circular-arc belt-like surface which is developed from the taper mounting surface of the manufacturing mold shown in FIG. 5.

Further, where the mounting surface of the manufacturing mold CW to which the diamond abrasive grains D are to be mounted is a taper surface 106 shown in FIG. 5, first of all, the three-dimensional taper surface 106 is developed into a flat surface taking a two-dimensional circular-arc belt-like surface 108, which as shown in FIG. 8, angularly extends over an angle of 240 degrees for example, wherein a pair of jointed edges 108*a*, 108*b* for looping the two-dimensional circular-arc belt-like surface 108 in forming the three-dimensional taper surface 106 are at one o'clock position and five o'clock position as counted from a prime reference line BL referred to next. Then, the prime reference line BL is set to cross the circular arc center of the circular-arc belt-like surface 108 at twelve o'clock position so that it becomes a parallel relation with one side of a grid pattern for a plurality of mounting points 104, as shown in FIG. 8. Then, the plurality of mounting points 104 are distributed in the grid pattern (refer to FIG. 9) and are assigned on the circular-arc belt-like surface 108 as coordinates for mounting the diamond abrasive grains D (two-dimensionally developed coordinate preparation step). It is to be noted that the angle over which the two-dimensional circular-arc belt-like surface 108 extends varies depending on the oblique angle of the taper surface 106 and that the angle of 240 degrees in this instance is for the purpose of explanation only.

In the neighborhood of the prime reference line BL and in the neighborhoods of two subprime reference lines FL (refer to FIG. 8) which are spaced angularly from the prime reference line BL through the angles of 90 degrees and 180 degrees (the both neighborhoods are referred to as "first predetermined angular ranges"), the mounting points 104 along rows perpendicular to a corresponding one of the prime and subprime reference lines BL, FL align in the circumferential direction of the circular-arc belt-like surface 108. As a result, in each of the first predetermined angular ranges, the mounting points 104 along the rows make a plurality of consecutive point lines extending in the circumferential direction, as typically shown in FIG. 10. Because two first predetermined angular ranges at nine o'clock position and six o'clock position on the two-dimensional circular-arc belt-like surface 108 simply move respectively to eight o'clock position and four o'clock position when the belt-like surface 108 is reconstructed into the three-dimensional taper surface 106 (that is, when the belt-like surface 108 is looped by being jointed at the jointed edges 108*a*, 108*b*), it results that when manufactured by the use of the manufacturing mold CW, a grinding tool would have the diamond abrasive grains D aligned in the circumferential direction thereof in each of the first predetermined angular ranges.

Figure 11:
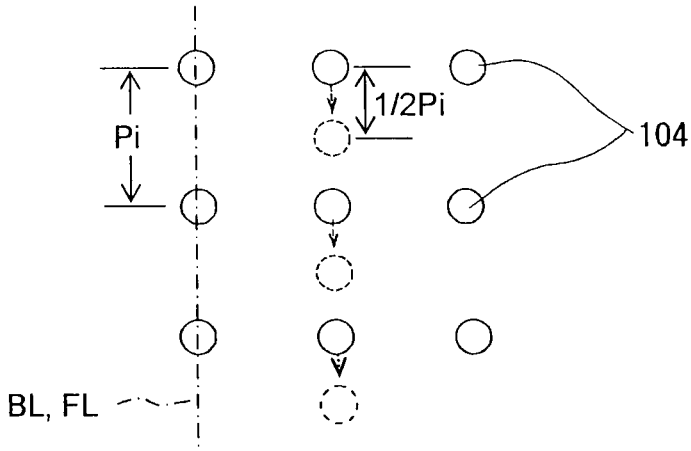
FIG. 11 is an explanatory view for showing the manner of shifting mounting points in the neighborhood of the prime reference line BL.
Figure 12:
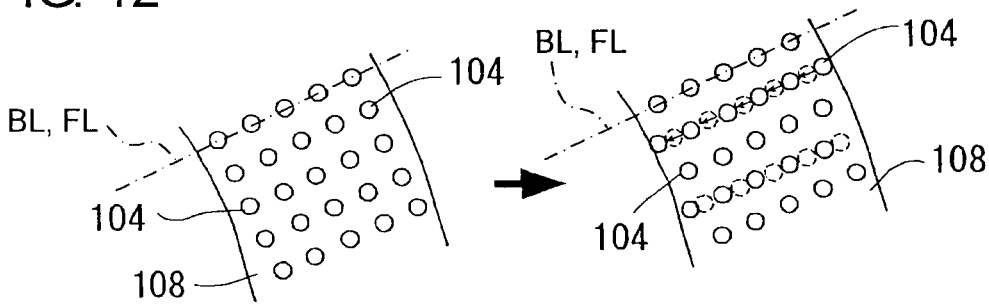
FIG. 12 is an explanatory view for showing a rectified grid pattern with shifted mounting points in comparison with the grid patter before rectification.

To obviate this defect, as shown in FIG. 11, mounting points 104 along every other or second row extending in parallel with a corresponding one of the prime and subprime reference lines BL, FL are shifted along its own row (i.e., almost in the radial direction) by the half (½ Pi) of the distance (Pi) between the two adjacent mounting points 104 of the grid pattern (rectification step). Rectification like this is carried out in each of the first predetermined angular ranges each covering an angle of 25 degrees which has its center on a corresponding one of the prime and subprime reference lines BL, FL spaced angularly at 90-degree intervals, as viewed in FIG. 8. FIG. 12 shows the mounting points 104 of the grid pattern so rectified in comparison with those points 104 of the grid pattern before such rectification. As a consequence, as typically shown in FIG. 13, the mounting points 104 along the side of the grid pattern perpendicular to a corresponding one of the prime and subprime reference lines BL, FL can be prevented from aligning consecutively (that is, from making a plurality of consecutive point lines) in the circumferential direction. In other words, in each of the first predetermined angular ranges, the mounting points 104 of each row perpendicular to a corresponding one of the prime and subprime reference lines BL, FL have every second mounting points which are deviated or offset from its own row, so that the mounting points 104 along each such row can be arranged in a zigzag fashion in the circumferential direction.

Figure 14:
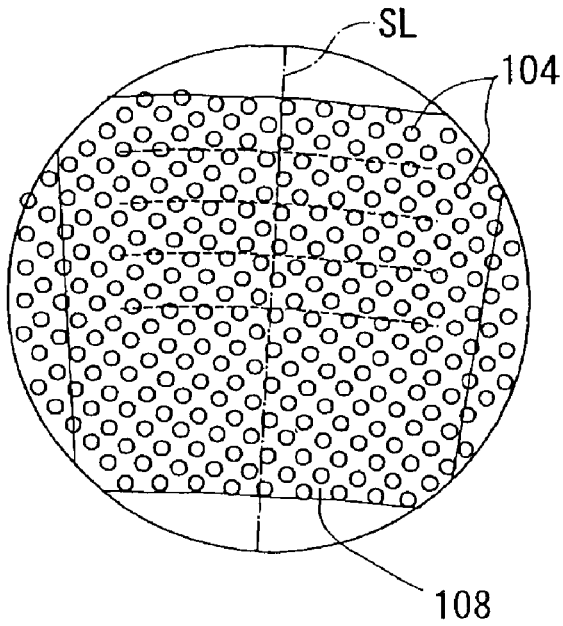
FIG. 14 is an enlarged fragmentary view of mounting points arranged in a grid pattern in the neighborhood of a secondary reference line SL shown in FIG. 8.

Further, referring again to FIG. 8, in each of the neighborhoods (referred to as "second predetermined angular ranges") of two secondary reference lines SL which are angularly spaced respectively through angles of 45 degrees and 135 degrees in the counterclockwise direction from the prime reference line BL, one diagonal line of the grid pattern becomes parallel with the circumferential direction of the manufacturing mold CW as shown in FIG. 14, so that the mounting points 104 in each of the second predetermined angular ranges make consecutive point lines in the circumferential direction of the manufacturing mold CW. This is because two second predetermined angular ranges are respectively at the mid position between eleven and ten o'clock positions and at the mid position between eight and seven o'clock positions on the two-dimensional circular-arc belt-like surface 108 and when the belt-like surface 108 is reconstructed into the three-dimensional taper surface 106, simply move respectively to about nine o'clock position and about five o'clock position (to be more exact, respectively to a 67.5-degree position and a 202.5-degree position as counted counterclockwise from the prime reference position BL). The aforementioned subprime reference lines FL and the secondary lines SL collectively define additional reference lines.

To obviate this defect, the mounting points 104 along rows which are in parallel to one or the other side of the grid pattern (i.e., in parallel to the prime reference line BL or the subprime reference line FL) are divided into plural groups each including three rows of the mounting points 104. Then, the mounting points 104 in a second raw of each group are shifted in one direction along its own row relative to those in a first row of the same group by one third (⅓ Pi) of the distance (Ri) between the two mounting points 104, while the mounting points 104 in a third raw of each group are shifted in the same direction along its own row relative to those in the second row by one third (⅓ Pi) of the distance (Ri) or in the opposite direction along its own row relative to those in the first row by one third (⅓ Pi) of the distance (Ri). The distance (Ri) corresponds to a point-to-point interval along any of the one and other sides of the grid pattern.

Figure 15:
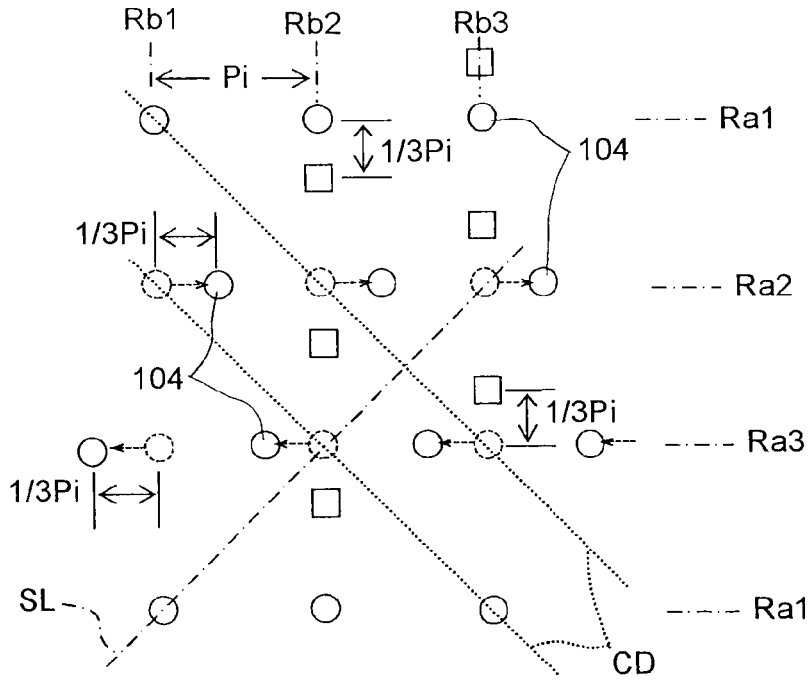
FIG. 15 is an explanatory view for showing the manner of shifting mounting points in the neighborhood of the secondary reference line SL.
Figure 16:
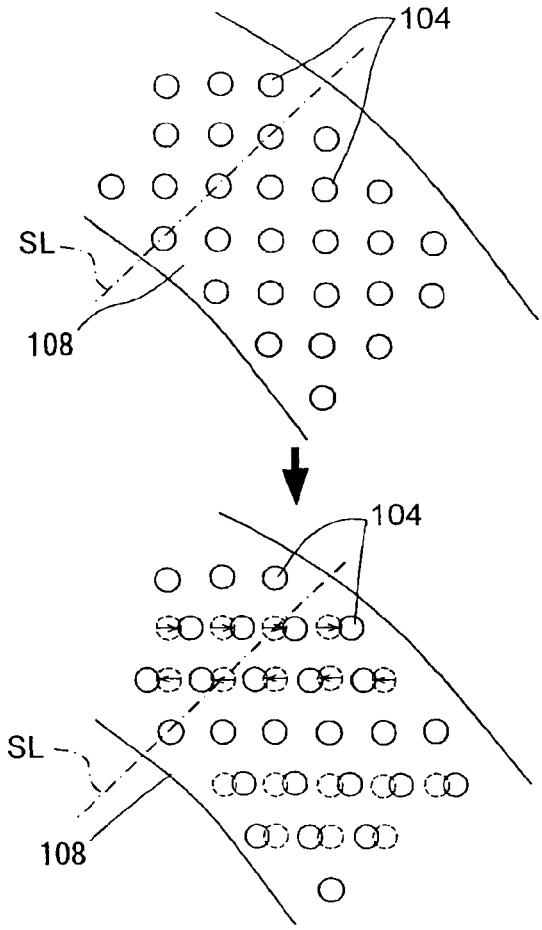
FIG. 16 is an explanatory view for showing a rectified grid pattern with shifted mounting points in comparison with the grid patter before rectification in the neighborhood of the secondary reference line SL.
Figure 17:
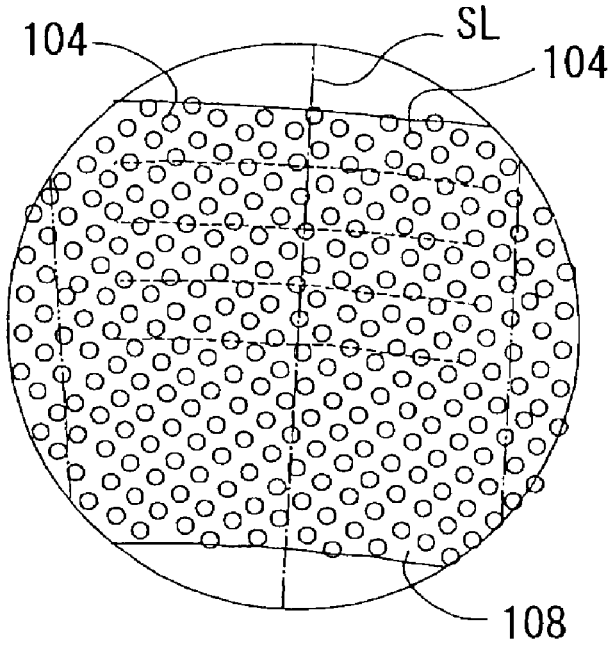
FIG. 17 is a fragmentary view of the same neighborhood as shown in FIG. 14 where the grip pattern has been rectified to shift every second and third rows of mounting points.

FIG. 15 exemplifies one group including first to third rows Ra1-Ra3 along the other side (orthogonal to the prime reference line BL) of the grid pattern, wherein the mounting points 104 (each indicated by a round hole) in the second and third rows Ra2, Ra3 are shifted in opposite directions along the respective own rows R2, R3 relative to those in the first row R1. Such rectification is carried out in each of the second predetermined angular ranges each covering an angle of 12.5 degrees which takes as the center a corresponding one of the secondary reference lines SL which are angularly spaced through the angles of 45 degrees and 135 degrees in the counterclockwise direction from the prime reference line BL. FIG. 16 shows the mounting points 104 of the grid pattern so rectified in comparison with those points 104 of the grid pattern before such rectification. As a consequence, as shown in FIG. 17, the mounting points 104 in each of the second predetermined angular ranges can be prevented from aligning consecutively (that is, from making a plurality of consecutive point lines) in the circumferential direction CD as shown in FIG. 15. In other words, in each of the second predetermined angular ranges, the mounting points 104 can be arranged in a zigzag fashion in the circumferential direction CD.

In a modified form, as also shown in FIG. 15, each group may be taken to include three rows Rb1-Rb3 parallel to the one side of the grid pattern (i.e., parallel to the prime reference line BL. In this modified form, the mounting points 104 (each indicated by a square hole) in the second and third rows Rb2 and Rb3 are shifted along their own rows by one third (⅓ Pi) of the distance (Pi) relative to those in the first row Rb1 in opposite directions. Alternatively, the mounting points 104 in the third rows Rb3 may be shifted along its own row by two third (⅔ Pi) of the distance (Pi) relative to those in the first row Rb1 in the same direction, that is, by one third (⅓ Pi) of the distance (Pi) relative to those of the second row Rb2 in the same direction.

Then, coordinates of the mounting points 104 on the circular arc belt-like surface 108 are reconstructed into the format of three-dimensional coordinates for use in mounting the superabrasive grains D on the manufacturing mold CW.

Figure 6:
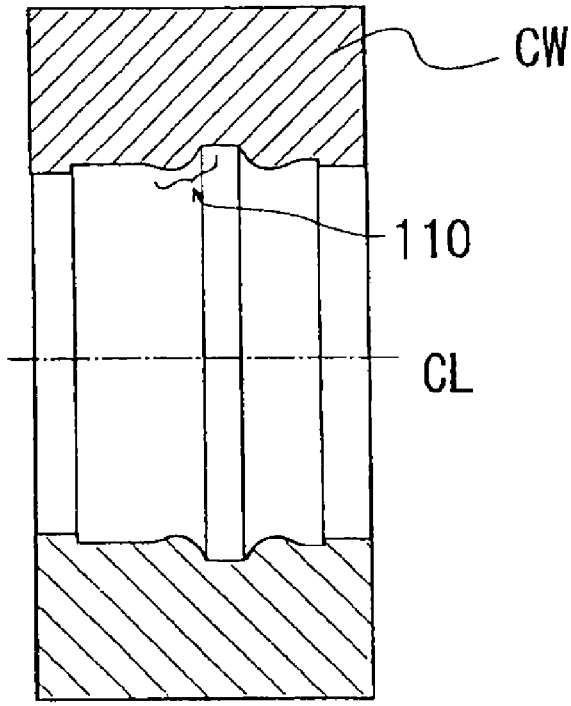
FIG. 6 is a longitudinal sectional view of the manufacturing mold in said one example showing a rounded mounting surface.
Figure 7:
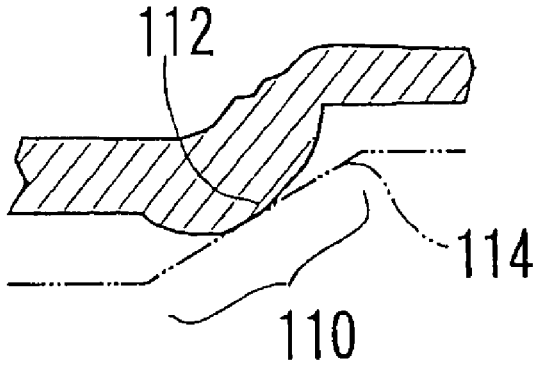
FIG. 7 is an enlarged fragmentary sectional view of the rounded mounting surface shown in FIG. 6.

Further, it may be the case that the mounting surface of the manufacturing mold CW is a rounded surface 110, as shown in FIG. 6. In this case, as shown in FIG. 7, a rounded portion 112 on the rounded surface 110 is assumed to be a taper surface 114 having an oblique side of the same length as the circular arc of the rounded portion 112, wherein mounting points 104 for arrangement of superabrasive grains are set on the aforementioned two-dimensionally developed coordinate system. Then, in the same way as the aforementioned taper mounting surface, a plurality of mounting points 104 to which diamond abrasive grains D are to be mounted are designated in a two-dimensional coordinate of the circular arc belt-like surface 108 shown in FIG. 8. In this way, by regarding the rounded mounting surface 110 as a taper surface which is easier to handle, the arrangement of the mounting points 104 on the rounded surface 110 can be rectified simply and speedy prior to the setting of the diamond abrasive grains D on the manufacturing mold CW.

Figure 18:
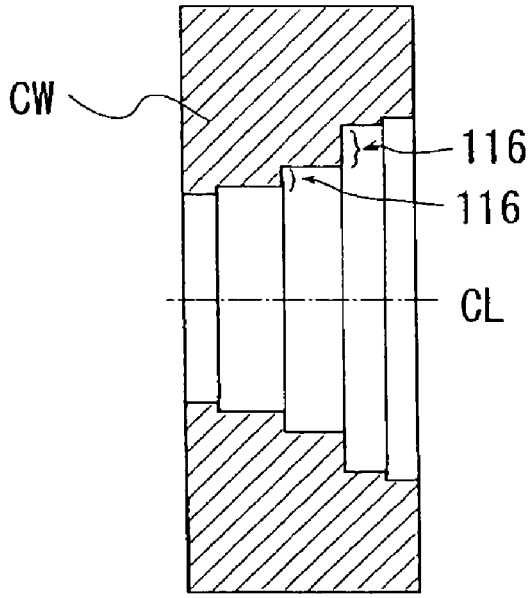
FIG. 18 is a longitudinal sectional view of a manufacturing mold in another example showing end mounting surfaces.
Figure 19:
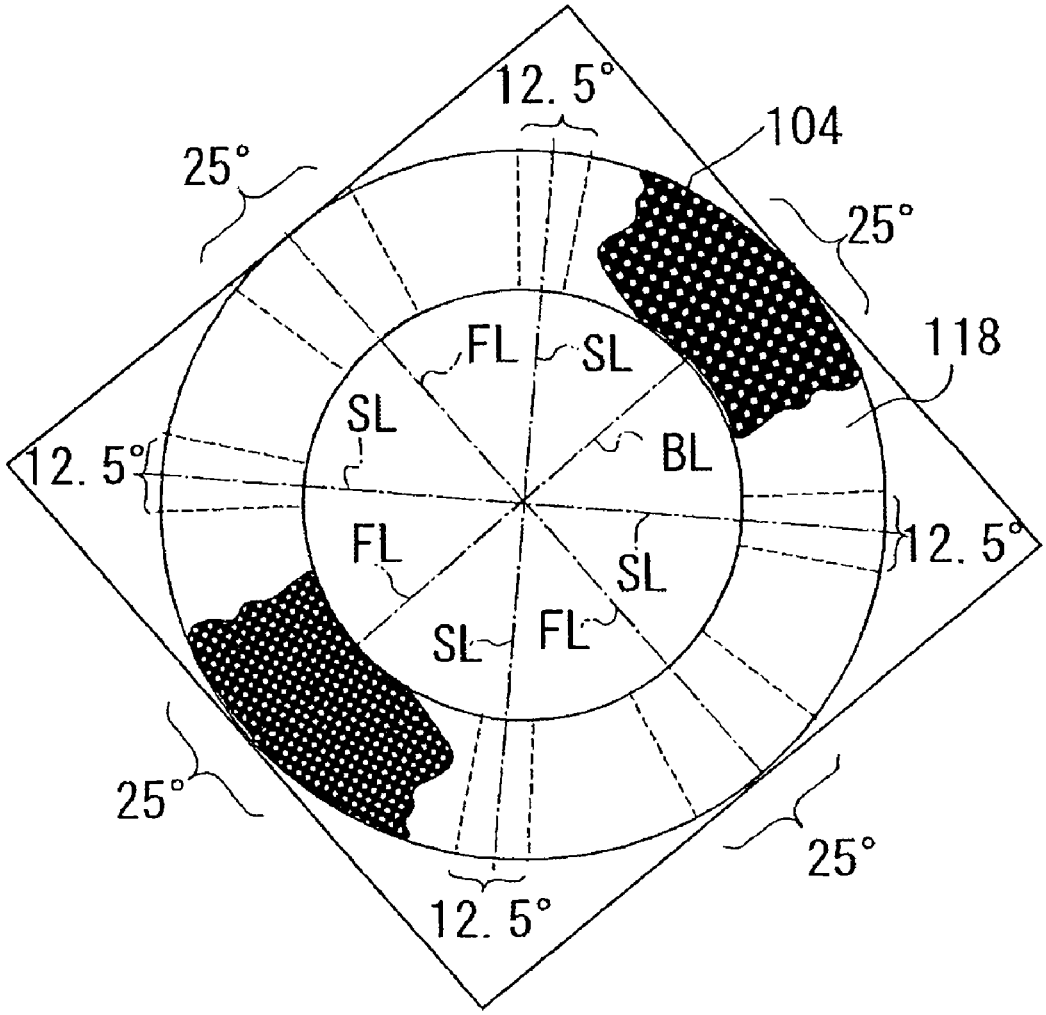
FIG. 19 is a plan view of a circular-arc belt-like surface for each of such end mounting surfaces.

Further, as shown in FIG. 18, the mountings should be done on end surfaces 116 which are right angle with the axis CL of the manufacturing mold CW. In this case, as shown in FIG. 19, mounting points 104 are assigned onto an annular belt-like surface 118 in the grid pattern (two-dimensionally developed coordinate preparation step). Like the aforementioned taper surface 106, a prime reference line BL is set to cross the circular arc center of the annular belt-like surface 118 at twelve o'clock position so that it becomes parallel with one side of a grid pattern for a plurality of mounting points 104, as shown in FIG. 19. Then, the plurality of mounting points 104 are distributed in the grid pattern and are assigned on the annular belt-like surface 118 as coordinates for mounting the diamond abrasive grains D (two-dimensionally developed coordinate preparation step).

Figure 10:
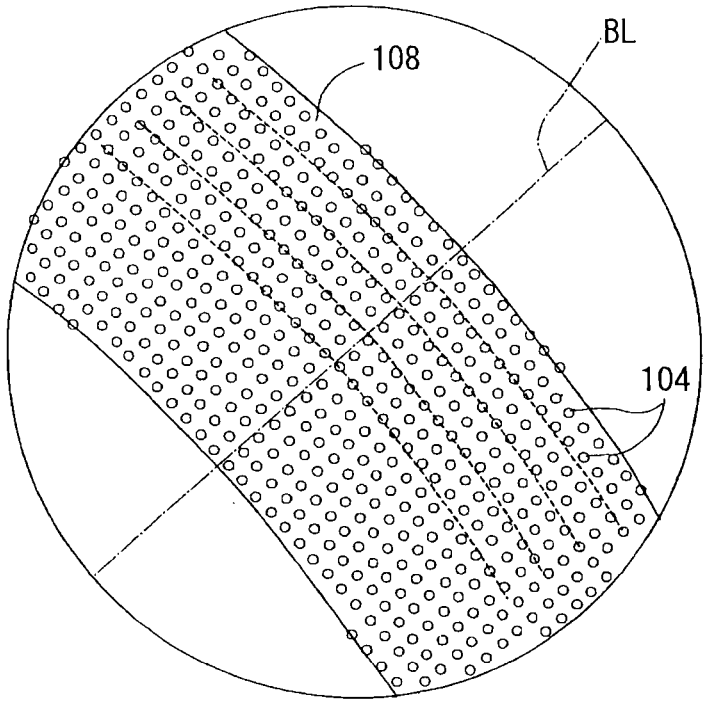
FIG. 10 is a fragmentary view covering a wider neighborhood than that covered in FIG. 9.

Like the aforementioned taper surface 106, as shown in FIG. 10, in the neighborhood of the prime reference line BL and in neighborhoods of three subprime reference lines FL angularly spaced from the prime reference line BL through angles of 90 degrees, 180 degrees and 270 degrees in one rotational direction (the neighborhoods are referred to as "first predetermined angular ranges), the mounting points 104 along rows each of which is perpendicular to a corresponding one of the prime reference line BL and the subprime reference lines FL align in the circumferential direction of the annular belt-like surface 118, whereby the mounting points 104 in each of the first predetermined angular ranges make consecutive point lines in the circumferential direction.

Figure 13:
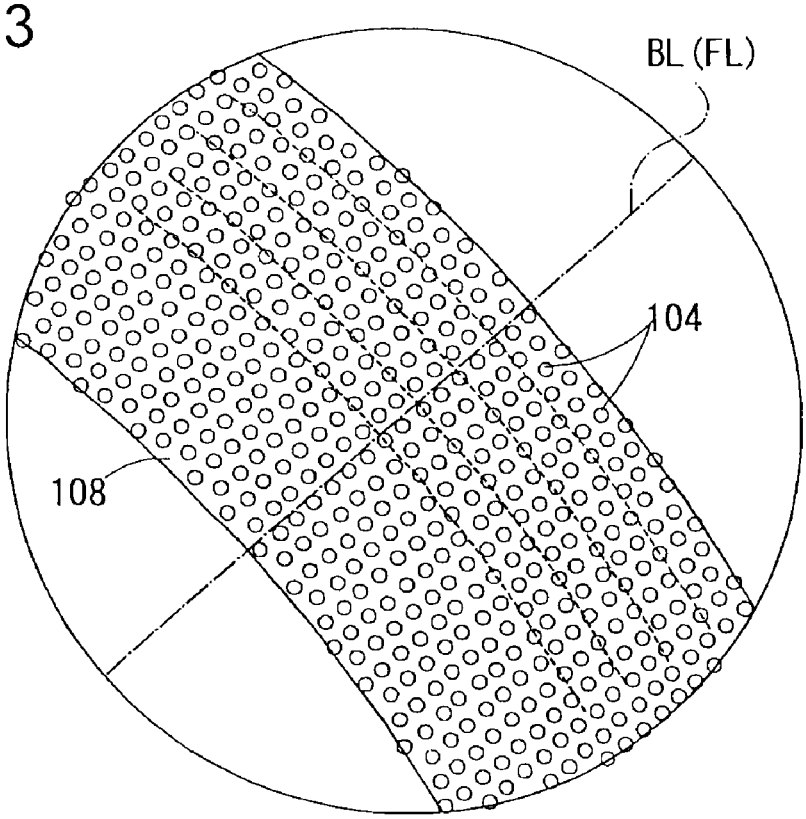
FIG. 13 is a fragmentary view of the same neighborhood as shown in FIG. 10 where the grip pattern has been rectified to shift every second row of mounting points.

To obviate this defect, the grid pattern in each of the four first predetermined angular ranges on the annular belt-like surface 118 shown in FIG. 19 is rectified in the same way as described with reference to FIGS. 11 and 12 in connection with the taper mounting surface, so that as typically shown in FIG. 13, the mounting points 104 along the side of the grid pattern perpendicular to a corresponding one of the prime and subprime reference lines BL, FL can be prevented from aligning consecutively (that is, from making a plurality of consecutive point lines) in the circumferential direction. In other words, in each of the four first predetermined angular ranges, the mounting points 104 along each row perpendicular to a corresponding one of the prime and subprime reference lines BL, FL have every second mounting points which are deviated or offset from its own row, so that the mounting points 104 along each such row can be arranged in a zigzag fashion in the circumferential direction.

Further, in the neighborhoods of four secondary reference lines SL which are angularly spaced respectively through angles of 45 degrees, 135 degrees, 225 degrees and 315 degress in one rotational direction from the prime reference line BL, one diagonal line of the grid pattern becomes parallel with the circumferential direction of the manufacturing mold CW, so that the mounting points 104 in each of the neighborhoods referred to as "second predetermined angular ranges" make consecutive point lines in the circumferential direction of the manufacturing mold CW.

To obviate this defect, the grid pattern in each of the four second predetermined angular ranges on the annular belt-like surface 118 shown in FIG. 19 is rectified in the same way as described with reference to FIGS. 15 and 16 in connection with the taper mounting surface. As a consequence, as shown in FIG. 17, the mounting points 104 in each of the four second predetermined angular ranges can be prevented from aligning consecutively (that is, from making a plurality of consecutive point lines) in the circumferential direction. In other words, in each of the second predetermined angular ranges, the mounting points 104 can be arranged in a zigzag fashion in the circumferential direction.

Then, coordinates of the mounting points 104 so rectified on the annular belt-like surface 118 are reconstructed into the format of three-dimensional coordinates for use in mounting the superabrasive grains D on the manufacturing mold CW. Herein, the annular belt-like surface 118 is regarded as a circular-arc belt-like surface extending over an angle of 360 degrees and is taken as one form of the aforementioned circular-arc belt-like surface 108 shown in FIG. 8. Further, each of the taper surface 106, the rounded surface 110 and the end surfaces 116 constitutes a non-cylindrical mounting surface area wherein the tangential line to each of the surfaces taken along the plane (i.e., longitudinal section) including the axis CL of the manufacturing mold CW crosses with the axis CL of the manufacturing mold CW.

(Operation)

Next, description will be made regarding the mounting process using the superabrasive setting apparatus 2 wherein the mounting coordinates have been determined as described above. First of all, as shown in FIG. 1, a manufacturing mold CW is loaded on the loading position on the loading table device 4. At this time, the manufacturing mold CW is held on the loading table device 4 in a horizontal state that it is stable. The loading table device 4 is then turned through an angle of 180 degrees to move the manufacturing mold CW from the loading position to the grip position. Then, the grip mechanism 40 having been raised beforehand is laid down by the operation of the raising air cylinder 68 to the horizontal position, and the chuck members 46 of the grip mechanism 40 reach the grip position where they are positioned at radially opposite sides of the manufacturing mold CW therebetween. The chuck members 46 are closed by the chucking air cylinder (not shown) to grip the circumferential surface of the manufacturing mold CW from the diametrically opposite sides thereof. With the manufacturing mold CW being gripped, the raising air cylinder 68 for the raising mechanism 42 is driven to pushingly swing the swing arm 66, whereby the grip mechanism 40 and the manufacturing mold CW gripped by the same are raised to the raised or upright position by the rotation of the raising rotary shaft 60 through an angle of 90 degrees.

Subsequently, the six-axis control robot 10 is started, an ID (identification) number of the manufacturing mold CW is checked, and a mounting program used for controlling the six-axis control robot 10 in mounting diamond abrasive grains D is selected in dependence on the checked ID number. The mounting program has been rectified as mentioned earlier in dependence on the shape of the mounting surfaces of the manufacturing mold CW so that in each of the first and second predetermined angular ranges, no consecutive point lines of the diamond abrasive grains D are made in the circumferential direction of the manufacturing mold CW.

In the beginning, the six-axis control robot 10 is controlled to access to the nozzle magazine (not shown) and selectively attaches to an extreme end of the endmost or fifth arm 84 a suction nozzle 74 which is suitable to a mounting surface for which the setting is to be done then. It is required for the suction nozzle to be able to direct the axis of the nozzle end or nose portion thereof perpendicularly of the mounting surface on which the diamond abrasive grains D are to be mounted and to be adapt itself to the depth of a groove or the like on the mounting surface of the manufacturing mold CW. The selection of the suction nozzle 74 is carried out in terms of satisfying these requirements. Then, the six-axis control robot 10 utilizes the suction nozzle 74 attached thereon as a touch probe in order to correct errors involved in the grip position of the manufacturing mold CW gripped by the grip and raising device 6 and dimensional errors involved in the manufacturing of the manufacturing mold CW. That is, by utilizing the suction nozzle 74 as a touch probe which is brought into contact with many places on the manufacturing mold CW, positions are detected for the front end surface and the hole center of the manufacturing mold CW in the state that the same is actually held by the grip and raising device 6. Three-dimensional coordinates at a program start point for the six-axis control robot 10 are calibrated by the detected position information regarding the front end surface and the hole center of the manufacturing mold CW, so that it becomes possible for the system controller to control the six-axis control robot 10 in setting diamond abrasive grains D from the calibrated program start position in accordance with the selected mounting program.

In parallel time relation with the aforementioned calibration of the six-axis control robot 10, one of the storage cases 92 containing the diamond abrasive grains D to be used in mounting is indexed to the supply position in the superabrasive grain supply device 8, and as shown in FIG. 1, one grain D of diamond abrasive is separated and protruded from numerous diamond abrasive grains D in the indexed storage case 92 by the lift-up rod 94 which is pushed up by the lift-up air cylinder (not show) at the supply position. At this time, judgments are made by the photoelectric detector (not shown) for the presence/absence and the quality (i.e., the propriety for use) of the grain D of diamond abrasive which is protruded to the suction position. If no grain of diamond abrasive is present or the quality is not suitable for use, the step of protruding another grain of diamond abrasive is performed again.

After the aforementioned calibration, the six-axis control robot 10 is controlled to move the suction nozzle 74 to the suction position and draws the grain D of diamond abrasive held at the suction position, onto the extreme end of the suction nozzle 74. Whether the grain D of diamond abrasive is on the suction nozzle 74 or not is judged by checking the difference between vacuum pressures which are detected by the pressure sensor (not shown) before and after the suction movement of the six-axis control robot 10. If the suction is not done correctly, the grain D of diamond abrasive on the suction nozzle 74 is thrown away into an NG (no-good) box (not shown), and the suction step is carried out again. Needless to say, the pressure sensor is provided on an air path line which connects the vacuum pump (not shown) as a negative-pressure supply to the suction nozzle 74 on the wrist unit 72 of the robot 10.

Next, the diamond abrasive grain D drawn on the suction nozzle 74 is transferred by the six-axis control robot 10 to a mounting start or reference position (not shown) which is before the manufacturing mold CW gripped by the grip and raising device 6 as shown in FIG. 2. Then, the six-axis control robot 10 is controlled to be moved from the mounting reference position in accordance with the mounting program which has been rectified not to align diamond abrasive grains D consecutively in the circumferential direction of the manufacturing mold CW as mentioned earlier. As a consequence, each grain D of diamond abrasive held on the suction nozzle 74 is mounted on a target mounting position on the manufacturing mold CW in accordance with the rectified mounting program. By the repetition of such mounting operation for each grain D of diamond abrasive, numerous diamond abrasive grains D are mounted on one or more mounting surfaces of the manufacturing mold CW. Since an adhesive has been applied to the mounting surfaces of the manufacturing mold CW in advance, the diamond abrasive grains D having been set on the mounting surfaces are held and adhered thereto by the adhesive.

The manufacturing mold CW on which the setting work of the diamond abrasive grains D has been completed is brought down by the grip and raising device 6 to the horizontal state and is placed at the grip position on the loading table device 4. Then, the grip and raising device 6 releases the manufacturing mold CW and turns up to the upright position to become ready for mold exchange. Since another or new manufacturing mold CW has already been loaded to the loading position on the loading table device 4, the subsequent half-turn of the loading table device 4 exchanges the mutual positions of the manufacturing mold CW which has been set with diamond abrasive grains D and the new manufacturing mold CW. The manufacturing mold CW on which the setting work has been completed is picked up from the loading table device 4 and is transferred to the next manufacturing process, while the new manufacturing mold CW is gripped by the grip and raising device 6 after the same is brought down, and is raised to the upright position, so that the setting work of diamond abrasive grains D is performed by the six-axis control robot 10 in the same manner as described above.

In the setting method practiced by using the aforementioned superabrasive grain setting apparatus 2, the non-cylindrical area of the manufacturing mold CW on which diamond abrasive grains D are to be arranged in a grid pattern is developed into the circular-arc belt-like surface 108 in the form of a plane, and the plurality of mounting points 104 in each of the aforementioned first and second predetermined angular ranges are rectified not to consecutively align in the circumferential direction of the circular-arc. By doing these simplified steps, it becomes possible to obviate such phenomena that each diamond abrasive grain behind those aligned consecutively does not contribute to a grinding operation, that some of the abrasive grains are delayed in abrasion from others and that much metal removal takes place at each of portions on a workpiece which are brought into contact with those portions making consecutive grain lines of a grinding wheel. Therefore, it becomes possible to manufacture the manufacturing mold CW speedy and reliably for subsequent use in manufacturing a grinding tool capable of performing precise grinding operations.

Further, because one diagonal line of the grid pattern becomes parallel with the circumferential direction of the circular-arc belt-like surface 108 in each of the second predetermined angular ranges, the mounting points 104 in each of the second predetermined angular ranges align consecutively in the circumferential direction of the manufacturing mold CW. To obviate this defect, the grid pattern is rectified so that the mounting points 104 in each of the second predetermined angular ranges do not make consecutive point lines. Accordingly, it becomes possible to manufacture a manufacturing mold used in manufacturing a grinding tool which is capable of performing precise grinding operations.

Further, in the first predetermined angular ranges each taking as its center a corresponding one of the prime reference line BL and the subprime reference line FL, the intervals of the mounting points 104 (i.e., the abrasive grains) becomes shorter though each such first predetermined angular range in which the mounting points 104 align in the circumferential direction of the manufacturing mold CW becomes somewhat wider. To obviate this defect, in each of the first predetermined angular ranges each covering an angle of 25 degrees with the center on a corresponding one of the prime reference line BL or the subprime reference lines FL, the mounting points 104 along every other or second row parallel to a corresponding one of the prime reference line BL and the subprime reference line FL are shifted along its own row from those along a row next thereto by one half (½ Pi) of the distance (Pi) between the two adjacent mounting points 104.

Also, in each of the second predetermined angular ranges each taking as its center a corresponding one of the secondary reference lines SL, the intervals of the mounting points 104 (i.e., the abrasive grains) becomes somewhat longer though each such second predetermined angular range in which the mounting points 104 align in the circumferential direction of the manufacturing mold CW becomes somewhat narrower. To obviate this defect, in each of the second predetermined angular ranges each covering an angle of 12.5 degrees with the center on a corresponding one of the secondary reference lines SL, the mounting points 104 along each row which is parallel to one or the other side of the grid pattern (i.e., parallel to the prime reference line BL or the subprime reference line FL) are shifted along its own row from those along a row next thereto by one third (⅓ Pi) of the distance (Pi) between the two adjacent mounting points 104. By incorporating such specific shift or offset values into the mounting program, it becomes possible to easily manufacture a manufacturing mold used in manufacturing a grinding tool which is capable of performing precise grinding operations.

Although in the foregoing embodiment, diamond abrasive grains are used as superabrasive grains, the present invention is not limited to the use of diamond abrasive grains. For example, CBN (Cubic Boron Nitride) abrasive grains may be used in place of diamond abrasive grains.

Further, the foregoing embodiment has been described taking a generally cylindrical manufacturing mold (female-type mold) wherein superabrasive grains are set on an internal surface of the female-type mold. However, the present invention is not limited to such a female-type mold. For example, the manufacturing mold may be a male-type mold wherein superabrasive grains are set on an external surface of the male-type mold.

Furthermore, the angular ranges in which the aforementioned rectification is carried out are determined to be an angle of 25 degrees for each of the first predetermined angular ranges and an angle of 12.5 degrees for each of the second predetermined angular ranges. However, the present invention is not limited to such specific angular ranges. The angular ranges for the aforementioned rectification may be suitably modified in dependence on the size of superabrasive grains used, the concentration of superabrasive grains or the like.

In addition, although in the foregoing embodiment, the direction in which the mounting points 104 are shifted is selected as a direction parallel with one or the other side of the grid pattern formed by a plurality of mounting points 104, the present invention is not limited to selecting the direction parallel with one or the other side of the grid pattern as the direction in which the mounting points are shifted. For example, the direction in which the mounting points are shifted may be any other direction. For example, the diagonal direction of the grid pattern may be selected in each of the first predetermined angular ranges, while a direction normal to the circumferential direction CD of the mounting mould CW may be selected in each of the second predetermined angular ranges.

Moreover, although in the foregoing embodiment, the grid pattern for arrangement of the superabrasive grains D is of a square point-to-point interval grid pattern wherein both sides (i.e., one and the other sides) of the grid pattern have the same point-to-point intervals, there may be used a rectangular point-to-point interval grid pattern wherein the point-to-point interval in one side is somewhat different from that in the other side.

Obviously, further modifications and variations of the present invention are possible in light of the above teachings. It is therefore to be understood that within the scope of the appended claims, the present invention may be practiced otherwise than as specifically described herein.

What is claimed is:

1. A superabrasive grain setting method for arranging in a grid pattern superabrasive grains on a mounting surface of a rotary shape manufacturing mold which is used in manufacturing a rotary grinding tool, the method comprising:

a two-dimensionally developed coordinate preparation step of developing a non-cylindrical area of the mounting surface where a tangential line to the mounting surface in a plane including the axis of the manufacturing mold crosses with the axis of the manufacturing mold, into a circular-arc belt-like surface in the form of a plane and setting a plurality of mounting points on the circular-arc belt-like surface in the grid pattern in dependence on mounting positions for the superabrasive grains, wherein in predetermined angular ranges whose centers are at different positions in the circumferential direction of the circular-arc belt-like surface, consecutive mounting points in the grid pattern align in the circumferential direction of the circular-arc belt-like surface;

a rectification step of rectifying the grid pattern of the mounting points in the predetermined angular ranges so that in each of the predetermined angular ranges, the consecutive mounting points in the grid pattern do not align in the circumferential direction of the circular-arc belt-like surface; and a mounting step for mounting the superabrasive grains on the mounting surface of the manufacturing mold based on the arrangement of the mounting points which are designated by the grid pattern rectified at the rectification step.

2. The superabrasive grain setting method as set forth in claim 1, wherein the rectification step including the steps of:

setting on the circular-arc belt-like surface a prime reference line which crosses a circular center of the circular-arc belt-like surface in parallel relation with one side of the grid pattern; and shifting the mounting points of the grid pattern in each of the predetermined angular ranges whose respective centers are on the prime reference line and on additional reference lines which are angularly spaced from the prime reference line at equiangular intervals.

3. The superabrasive grain setting method as set forth in claim 2, wherein:

the additional reference lines include at least two subprime reference lines which are spaced angularly from the prime reference line respectively through angles of 90 degrees and 180 degrees in one direction; and the predetermined angular ranges include at least three first predetermined angular ranges respectively taking the prime reference line and the at least two subprime reference lines as centers thereof and each covering a first predetermined angle.

4. The superabrasive grain setting method as set forth in claim 3, wherein:

in each of the at least three first predetermined angular ranges, mounting points along each row parallel to a corresponding one of the prime reference line and one of the at least two subprime reference lines are shifted along the respective its row from mounting points in a row next thereto by half of the distance between two adjacent mounting points.

5. The superabrasive grain setting method as set forth in claim 4, wherein:

the additional reference lines further include at least two secondary reference lines which are spaced angularly from the prime reference line respectively through angles of 45 degrees and 135 degrees in one direction; and the predetermined angular ranges further include at least two second predetermined angular ranges respectively centered on the at least two secondary reference lines and each covering a second predetermined angle which is narrower than the first predetermined angle.

6. The superabrasive grain setting method as set forth in claim 5, wherein:

in each of the at least two second predetermined angular ranges, mounting points along three rows parallel to one or the other side of the grid pattern which side is inclined at an angle of 45 degrees relative to a corresponding one of the secondary reference lines are taken as a group, wherein the mounting points along a second row of each group are shifted along its own row from the mounting points along a first row of the same group by one third of the distance between two adjacent mounting points and wherein the mounting points along a third row of each group are shifted along its own row from the mounting points along the second row of the same group by one third of the distance between the two adjacent mounting points in the same direction as the mounting points along the second row of the same group are shifted, or shifted along its own row from the mounting points along the first row of the same group by one third of the distance between the two adjacent mounting points in a direction opposite to the direction in which the mounting points along the second row of the same group are shifted.

7. The superabrasive grain setting method as set forth in claim 6, wherein the first predetermined angle covers an angle of 25 degrees while the second predetermined angle covers an angle of 12.5 degrees.

8. The superabrasive grain setting method as set forth in claim 1, wherein the non-cylindrical area of the mounting surface is one of a taper surface, a rounded surface and an end surface of the rotary shape manufacturing mold.

9. The superabrasive grain setting method as set forth in claim 8, wherein where the non-cylindrical area of the mounting surface is the rounded surface having an arc center in a plane including the axis of the rotary shape manufacturing mold, the circular-arc belt-like surface is prepared by regarding the round surface as a taper surface having an oblique side whose length is the same as the length of the arc of the rounded surface.

* * * * *